US009692138B2

(12) United States Patent
Onaka et al.

(10) Patent No.: US 9,692,138 B2
(45) Date of Patent: Jun. 27, 2017

(54) ANTENNA DEVICE

(71) Applicant: MURATA MANUFACTURING CO., LTD., Nagaokakyo-Shi, Kyoto-fu (JP)

(72) Inventors: Kengo Onaka, Nagaokakyo (JP); Hiroya Tanaka, Nagaokakyo (JP)

(73) Assignee: MURATA MANUFACTURING CO., LTD., Nagaokakyo-Shi, Kyoto-Fu (JP)

( * ) Notice: Subject to any disclaimer, the term of this patent is extended or adjusted under 35 U.S.C. 154(b) by 512 days.

(21) Appl. No.: 14/471,221

(22) Filed: Aug. 28, 2014

(65) Prior Publication Data

US 2014/0368397 A1 Dec. 18, 2014

Related U.S. Application Data

(63) Continuation of application No. PCT/JP2013/052859, filed on Feb. 7, 2013.

(30) Foreign Application Priority Data

Apr. 2, 2012 (JP) ..... 2012-083677

(51) Int. Cl.

| | |
|---|---|
| ***H01Q 19/185*** | (2006.01) |
| ***H01Q 19/10*** | (2006.01) |
| ***H01Q 9/26*** | (2006.01) |
| ***H01Q 13/10*** | (2006.01) |
| ***H01Q 21/20*** | (2006.01) |

(52) U.S. Cl.

CPC ..... *H01Q 19/185* (2013.01); *H01Q 9/26* (2013.01); *H01Q 13/10* (2013.01); *H01Q 19/10* (2013.01); *H01Q 21/205* (2013.01)

(58) Field of Classification Search

USPC ..... 343/700 MS, 837

See application file for complete search history.

(56) References Cited

U.S. PATENT DOCUMENTS 6,008,773 A 12/1999 Matsuoka et al.
8,854,270 B2 * 10/2014 Lee ..... H01Q 9/285 343/725

(Continued)

FOREIGN PATENT DOCUMENTS

JP H10-150319 A 6/1998
JP 2001-320225 A 11/2001

(Continued)

OTHER PUBLICATIONS

Written Opinion and International Search Report issued in PCT/JP2013/052859, mailed on Apr. 23, 2013.

*Primary Examiner* — Howard Williams
(74) *Attorney, Agent, or Firm* — Arent Fox LLP

(57) ABSTRACT

A substrate includes a dielectric plate and a conductive layer formed on both surfaces of the dielectric plate, and a first cutout is formed in the conductive layer on both surfaces of the substrate so as to extend inward from part of a first edge of the substrate. A first radiation electrode is connected to the conductive layer at a first point located on an outer peripheral line of the first cutout. A first reflector plate is disposed in a location further inward in the substrate from the first edge than the first point. The reflector plate is electrically connected to the conductive layer, and faces toward the first point. Thus an antenna device that is suited to miniaturization and that is capable of increasing directivity is provided.

20 Claims, 13 Drawing Sheets

(56) References Cited

U.S. PATENT DOCUMENTS

| | | | | |
|---|---|---|---|---|
| 2007/0057854 | A1 | 3/2007 | Oodachi et al. | |
| 2007/0188400 | A1* | 8/2007 | Fujita | H01Q 13/08 343/834 |
| 2009/0231215 | A1 | 9/2009 | Taura | |
| 2010/0117833 | A1 | 5/2010 | Kai et al. | |
| 2010/0289713 | A1* | 11/2010 | Taura | H01Q 1/243 343/767 |
| 2011/0043432 | A1* | 2/2011 | Ineichen | H01Q 1/38 343/876 |

FOREIGN PATENT DOCUMENTS

| | | | |
|---|---|---|---|
| JP | 2003-115715 | A | 4/2003 |
| JP | 2003-309428 | A | 10/2003 |
| JP | 2007-081712 | A | 3/2007 |
| JP | 2010-245892 | | 10/2010 |
| WO | WO-01/82408 | A1 | 11/2001 |
| WO | WO-2007/058230 | A1 | 5/2007 |
| WO | WO-2009/014213 | A1 | 1/2009 |

* cited by examiner

ANTENNA DEVICE

CROSS REFERENCE TO RELATED APPLICATIONS

The present application is a continuation of PCT/JP2013/052859 filed Feb. 7, 2013, which claims priority to Japanese Patent Application No. 2012-083677, filed Apr. 2, 2012, the entire contents of each of which are incorporated herein by reference.

FIELD OF THE INVENTION

The present invention relates to antenna devices in which a cutout is provided in a conductive layer formed on a dielectric plate.

BACKGROUND OF THE INVENTION

Patent Document 1 discloses an antenna device capable of reducing production costs and antenna weight. This antenna device includes a dipole antenna disposed forward from a center area of a reflector plate. The reflector plate includes foldover portions on both side portions thereof.

Patent Document 2 discloses an antenna device capable of variably setting a horizontal radiation beam width over a wide range. This antenna device has a structure in which a dielectric layer and a radiating element are stacked upon a ground conductor plate. Furthermore, a reflector is provided at a predetermined distance from the ground conductor plate, on both side portions on a bottom surface of the ground conductor plate.

Patent Document 3 discloses an antenna device having a radiation pattern that is almost nondirectional. In this antenna device, a built-in antenna is attached to a power supply point of a first conductor plate. A second conductor plate is provided on a different side of the first conductor plate from the side on which the built-in antenna is disposed. One side (a ground side) of the second conductor plate is grounded to the first conductor plate.

Patent Document 1: Japanese Unexamined Patent Application Publication No. 2010-245892

Patent Document 2: Japanese Unexamined Patent Application Publication No. 2003-115715

Patent Document 3: Japanese Unexamined Patent Application Publication No. 2007-81712

SUMMARY OF THE INVENTION

It is an object of the present invention to provide an antenna device that is suited to miniaturization and that is capable of increasing directivity.

A first aspect of the present embodiment provides an antenna device including a substrate having a dielectric plate and a conductive layer formed on both surfaces of the dielectric plate, a first cutout that is formed in the conductive layer on both surfaces of the substrate and that extends inward from part of a first edge of the substrate, a first radiation electrode that is connected to the conductive layer at a first point on an outer peripheral line of the first cutout, and a first reflector plate, disposed in a location further inward in the substrate from the first edge than the first point and facing toward the first point, that is conductive and electrically connected to the conductive layer.

The first reflector plate increases the directivity of electromagnetic waves emitted from the vicinity of the first edge.

The conductive layer may be isolated to be divided into a first conductive portion that extends from the first cutout along the first edge in opposite directions and a second conductive portion that is disposed further inward than the first conductive portion as seen from the first edge. A gap is provided between the first conductive portion and the second conductive portion, and the first reflector plate is electrically connected to the second conductive portion.

When the conductive layer is isolated to be divided into the first conductive portion and the second conductive portion, a front-to-back ratio (F/B ratio) of the radiation strength is increased.

The first reflector plate may be attached to the substrate so as to be perpendicular to the substrate.

Furthermore, a high-frequency circuit may be disposed in a region of the substrate that is further inward on the substrate from the first edge than the first reflector plate. Here, the first radiation electrode is connected to the high-frequency circuit by a first transmission line. The first transmission line intersects with an imaginary plane on which the first reflector plate is disposed, and is electrically insulated from the first reflector plate.

The first reflector plate may be disposed on both surfaces of the substrate. The height of the first reflector plate relative to the substrate may be different on either side of the substrate. Through this, the directivity can be tilted from an in-plane direction of the substrate to a thickness direction of the substrate.

The substrate may have a polygonal shape when viewed from above. The first edge corresponds to one side of the polygonal shape. Furthermore, a second cutout that is formed in the conductive layer and that extends from part of at least one second edge of the substrate that corresponds to another side of the polygonal shape, a second radiation electrode that is connected to the conductive layer at a second point on an outer peripheral line of the second cutout, and a second reflector plate, disposed in a location further than the second point as seen from the second edge and facing toward the second point, that is conductive and electrically connected to the conductive layer, may be provided.

Through this, the radiation field strength can be increased in a plurality of headings in the in-plane direction of the substrate.

The directivity of radiation strength can be increased by providing the first reflector plate. By isolating the substrate to divide into the first conductive portion and the second conductive portion, the front-to-back ratio of the radiation strength can be increased. By disposing the first reflector plate on both sides of the substrate and setting the first reflector plate to different heights on either side of the substrate, the directivity can be tilted from an in-plane direction of the substrate to a thickness direction of the substrate. By employing a polygonal shape in the substrate and providing cutouts or the like in positions of the conductive layer corresponding to the respective sides thereof, the radiation field strength can be increased in a plurality of headings.

DETAILED DESCRIPTION OF THE PREFERRED EMBODIMENTS

Figure 1A:
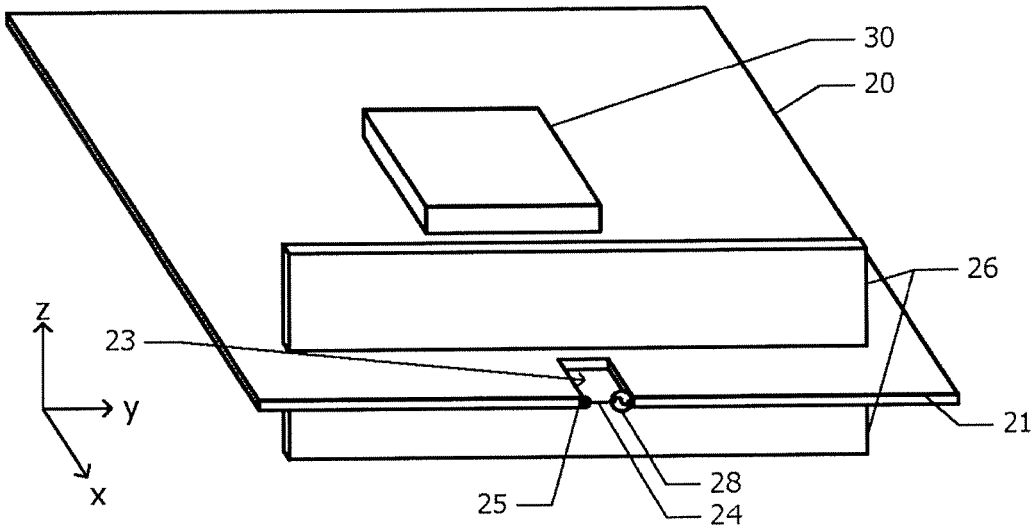
FIG. 1A is a perspective view illustrating an antenna device according to a first embodiment.

FIG. 1A is a schematic perspective view illustrating an antenna device according to a first embodiment. A cutout 23 is provided in a part, such as a central part, of one edge 21 of a substantially quadrangular substrate 20. As will be described later, the substrate 20 includes a dielectric plate and conductive layers formed on both surfaces of the dielectric plate. The cutout 23 is formed in the conductive layers. The cutout may be formed only in the conductive layers, or may be formed in both the dielectric plate and the conductive layers. An xyz orthogonal coordinate system is defined so that a direction parallel to the edge 21 is a y direction, a direction toward the edge 21 from the center of the substrate 20 is an x direction, and a direction perpendicular to the substrate 20 is a z direction.

The cutout 23 extends toward an inner side portion of the substrate 20 from the edge 21 (that is, in a negative direction on the x-axis). A radiation electrode 24 is connected to the conductive layers of the substrate 20 at a first point 25 located on an outer peripheral line of the cutout 23. A potential difference is produced between the conductive layer on one side of the cutout 23 (a positive y-axis side) and the conductive layer on the other side of the cutout 23 (a negative y-axis side). As one example, an outer conductor and a center conductor of a coaxial cable are connected to respective opposite edges of the cutout 23. The first point 25 to which the center conductor is connected is called a ground point (a short point). An exposed portion of the center conductor spanning from the location where the outer conductor is connected to the short point 25 corresponds to the radiation electrode 24. The radiation electrode 24 configures part of the radiating element. An end portion of the exposed center conductor on the opposite side as the short point 25 is called a power supply point 28. The positive direction along the x direction is referred to as "forward", and the negative direction is referred to as "rearward".

A reflector plate 26 is disposed in a location that is beyond a leading end portion of the cutout 23 (that is, the deepest point of the cutout 23 when facing from the edge 21 toward the inner side area of the substrate 20) when facing toward the inner side area of the substrate 20 from the edge 21 (that is, in the negative direction along the x-axis). The reflector plate 26 is electrically connected to the conductive layers of the substrate 20, and is fixed to the substrate 20 so as to face toward the short point 25 (in the positive direction along the x-axis). For example, the reflector plate 26 is parallel to the edge 21 and perpendicular to the substrate 20 (that is, is parallel to a yz plane). This antenna device has directivity characteristics such that a forward radiation strength is greatest in an xy plane.

Furthermore, a high-frequency circuit 30 is mounted in a position that is further toward the inner side area of the substrate 20 from the edge 21 than the reflector plate 26. The high-frequency circuit 30 supplies high-frequency power to the radiation electrode 24.

Although FIG. 1A illustrates an example in which the reflector plate 26 is disposed on both surfaces of the substrate 20, the reflector plate 26 may instead be disposed on only one of the stated surfaces. Furthermore, although the reflector plate 26 is disposed beyond a leading end portion of the cutout 23 when facing toward the inner side area of the substrate 20 from the edge 21 FIG. 1A, the reflector plate 26 may be disposed in any position that is further from the short point 25.

Figure 1B:
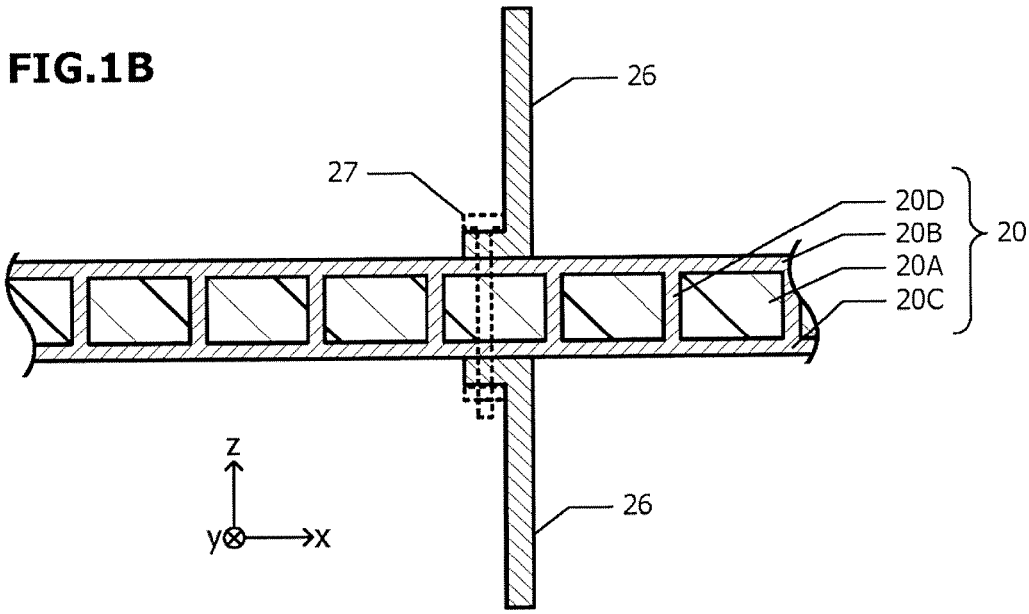
FIG. 1B is a partial cross-sectional view illustrating the antenna device according to the first embodiment.

FIG. 1B is a cross-sectional view of the substrate 20 and the reflector plate 26. The substrate 20 includes a dielectric plate 20A, an upper conductive layer 20B, a lower conductive layer 20C, and through vias 20D. The upper conductive layer 20B and the lower conductive layer 20C are disposed on an upper surface and a lower surface of the dielectric plate 20A, respectively. The through vias 20D are disposed within through-holes formed in the dielectric plate 20A, and electrically connect the upper conductive layer 20B and the lower conductive layer 20C to each other. The dielectric plate 20A, the upper conductive layer 20B, the lower conductive layer 20C, and the through vias 20D can be thought of as a single conductor plate in an operational frequency band of the antenna device. Note that cutouts are provided in the upper conductive layer 20B and the lower conductive layer 20C in the location of the cutout 23 (FIG. 1A), whereas a cutout is not formed in the dielectric plate 20A. The dielectric plate 20A remains in the area corresponding to the cutout 23, but the structure is electrically equivalent to a structure in which the cutout 23 is formed in the single conductor plate.

The upper and lower portions of the reflector plate 26 are formed of metal plates such as copper plates, and one edge thereof is bent in an L shape. A leading end portion beyond the bend is fixed to the substrate 20 using a fastener 27 such as a bolt, a nut, and so on. The reflector plate 26 may be fixed to the upper conductive layer 20B and the lower conductive layer 20C using solder or the like instead of attaching with the fastener 27. Furthermore, a substrate in which a metal foil is formed on the surface of a dielectric plate may be used as the reflector plate 26 instead of a metal plate. Copper foil that is 1 μm to 2 μm thick, for example, can be used as the metal foil.

Figure 2A:
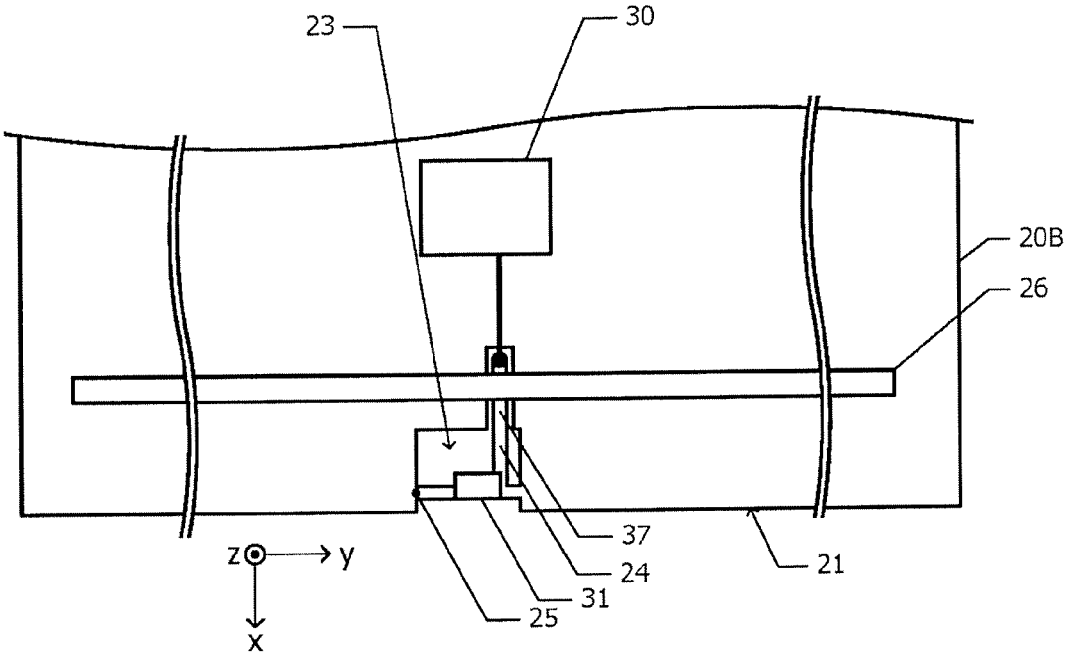
FIGS. 2A and 2B are a partial plan view and a partial bottom view, respectively, illustrating the antenna device according to the first embodiment.

FIG. 2A is a plan view illustrating an area where the cutout 23 is formed, the edge 21, and the periphery thereof. The cutout 23 is formed in the upper conductive layer 20B. The high-frequency circuit 30, which is capable of sending and receiving signals, for example, is mounted on the upper conductive layer 20B. The reflector plate 26 is disposed between the high-frequency circuit 30 and the cutout 23. The radiation electrode 24 disposed on the inner side area of the cutout 23 is connected to the high-frequency circuit 30 via a transmission line 37. The transmission line 37 intersects with the reflector plate 26. Meanwhile, the radiation electrode 24 is connected to the short point 25 via a capacitive reactance element 31 disposed within the cutout 23. The capacitive reactance element 31 has an effect of deepening the effective depth of the cutout 23.

Furthermore, the radiation electrode 24 is shorted on a side surface of the cutout 23, on the opposite side as the short point 25. This shorting enables impedance matching to be achieved.

Figure 2B:
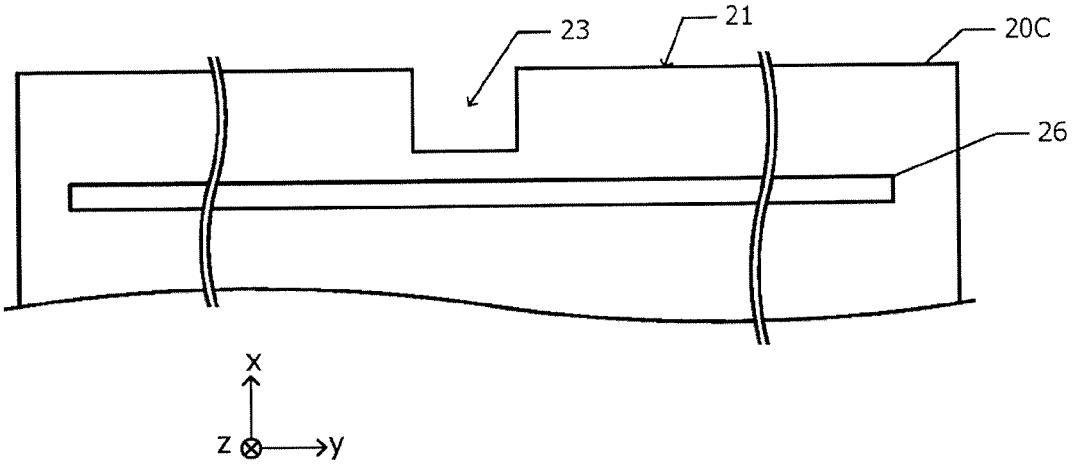

FIG. 2B is a bottom view illustrating an area where the cutout 23 is formed, the edge 21, and the periphery thereof. The cutout 23 is formed in the lower conductive layer 20C. The cutout 23 formed in the upper conductive layer 20B and the cutout 23 formed in the lower conductive layer 20C overlap in the in-plane direction of the xy plane. The dielectric plate 20A (FIG. 1B) remains on the inner side of the cutout 23. The lower portion of the reflector plate 26 is fixed to an area slightly rearward from the deepest area of the cutout 23.

Figure 3A:
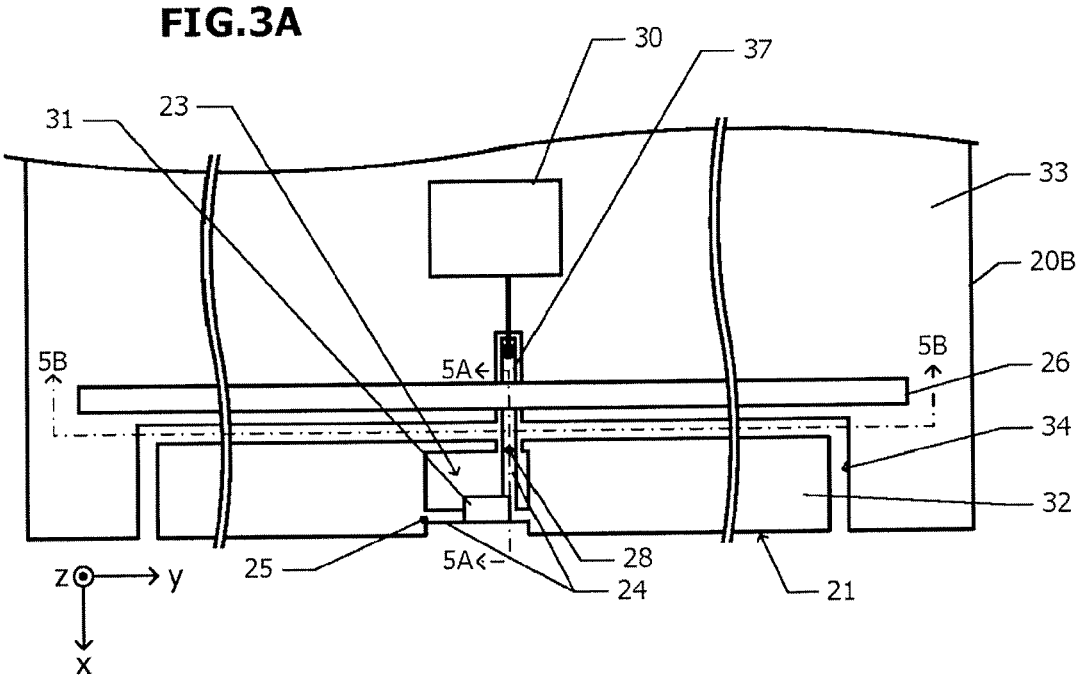
FIGS. 3A and 3B are a partial plan view and a partial bottom view, respectively, illustrating an antenna device according to a second embodiment.
Figure 3B:
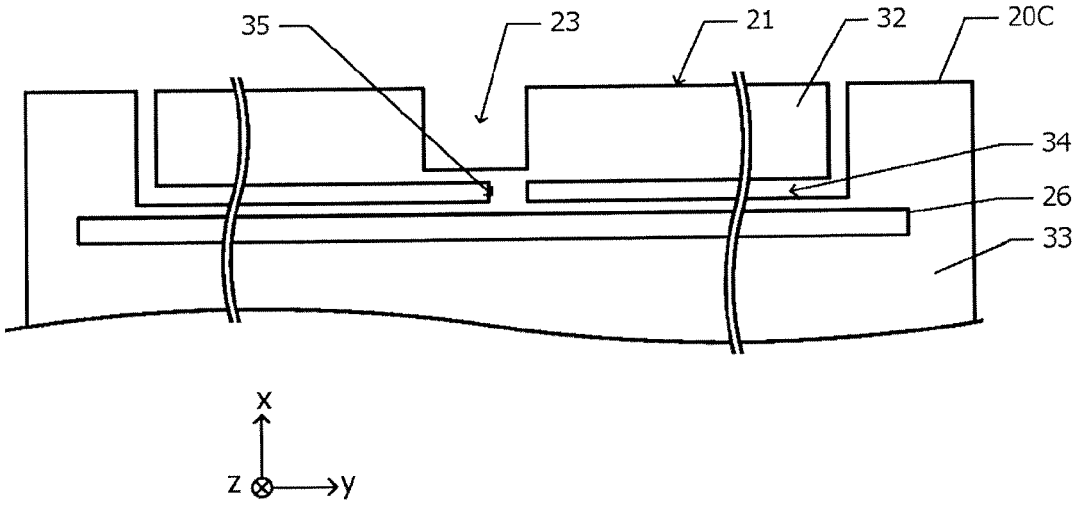

FIGS. 3A and 3B are a partial plan view and a partial bottom view, respectively, illustrating an antenna device according to a second embodiment. Hereinafter, differences from the first embodiment will be described, whereas descriptions of identical configuration will be omitted. FIGS. 3A and 3B illustrate areas corresponding to the areas illustrated in FIGS. 2A and 2B of the first embodiment.

As shown in FIG. 3A, in the second embodiment, the upper conductive layer 20B is isolated to be divided into a first conductive portion 32 and a second conductive portion 33 by an isolation band (gap) 34. The first conductive portion 32 extends from the cutout 23 along the edge 21 in mutually opposite directions (that is, to the positive and negative sides of the y direction). The second conductive portion 33 is disposed on an inner side of the first conductive portion 32 as seen from the edge 21. The isolation band 34 is configured of an area that extends parallel to the edge 21 and areas that extend toward the edge 21 at a right angle from both ends of the area that extends parallel to the edge 21. The area that extends parallel to the edge 21 is disposed between the cutout 23 and the reflector plate 26. The reflector plate 26 is electrically shorted to the second conductive portion 33.

The radiation electrode 24 disposed on the inner side area of the cutout 23 is connected to the high-frequency circuit 30 via the transmission line 37. After intersecting with the first conductive portion 32 and the isolation band 34, the transmission line 37 intersects with the reflector plate 26, and then proceeds toward the high-frequency circuit 30. The transmission line 37 and the first conductive portion 32 are insulated from each other at the point of intersection. The transmission line 37 enters into a region where the second conductive portion 33 is disposed. A slit that is wider than the transmission line 37 is formed in a region where the transmission line 37 is disposed in order to ensure that the transmission line 37 and the second conductive portion 33 are insulated from each other. The transmission line 37 is disposed within this slit. The power supply point 28 serves as a point of connection between the transmission line 37 and the radiation electrode 24.

As shown in FIG. 3B, the isolation band 34 is also formed in the lower conductive layer 20C. The lower conductive layer 20C is isolated to be divided into the first conductive portion 32 and the second conductive portion 33 by the isolation band 34. However, a ground layer 35 is disposed on a base surface of a region corresponding to a location where the transmission line 37 (FIG. 3A) and the isolation band 34 intersect. The ground layer 35 connects the first conductive portion 32 and the second conductive portion 33 that are formed on the base surface of the dielectric plate 20A (FIG. 1B). The reflector plate 26 on the base surface side is also electrically shorted to the second conductive portion 33.

Figure 4:
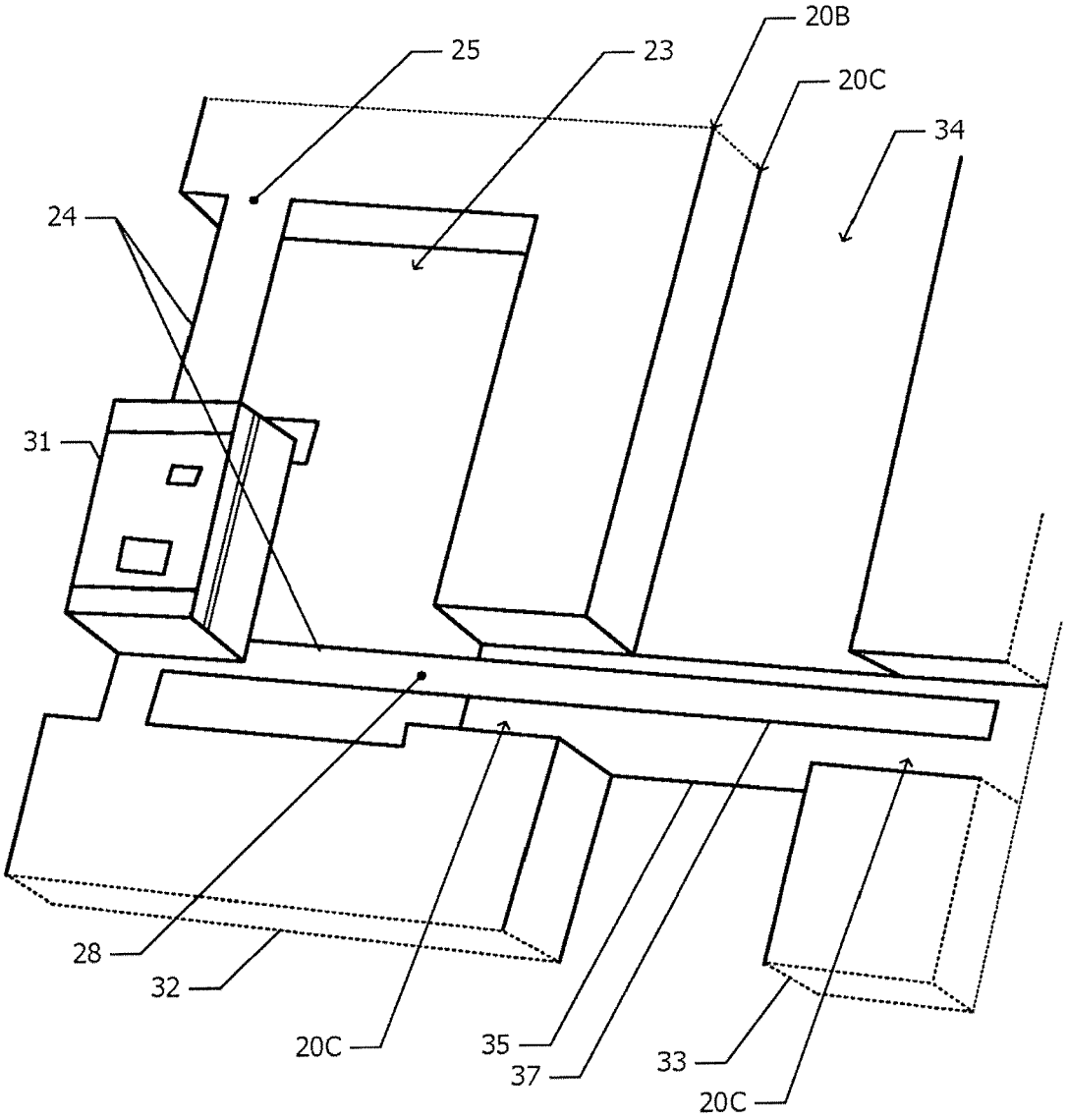
FIG. 4 is a perspective view illustrating a radiation electrode, a cutout portion, and the vicinity thereof in the antenna device according to the second embodiment.

FIG. 4 is a perspective view illustrating the radiation electrode 24, the transmission line 37, and the vicinity thereof. In FIG. 4, the dielectric plate 20A, the upper conductive layer 20B, the lower conductive layer 20C, and the through vias 20D illustrated in FIG. 1B are expressed as a single conductor plate. The transmission line 37 and the ground layer 35 are not mutually connected by the through vias 20D (FIG. 1B) provided in the dielectric plate 20A (FIG. 1B). Accordingly, in FIG. 4, the upper conductive layer 20B (FIG. 1B) and the lower conductive layer 20C (FIG. 1B) are indicated separately. The transmission line 37 is configured by part of the upper conductive layer 20B, and the ground layer 35 is configured by part of the lower conductive layer 20C. Note that the reflector plate 26 is not shown in FIG. 4.

The radiation electrode 24 disposed in the region within the cutout 23 continues as the transmission line 37 at the power supply point 28. The transmission line 37 intersects with the isolation band 34 and extends into the region where the second conductive portion 33 is disposed. The ground layer 35 is disposed in the location where the transmission line 37 and the isolation band 34 intersect. The ground layer 35 and the transmission line 37 configure a microstrip line. The lower conductive layer 20C formed on the base surface of the dielectric plate 20A and the transmission line 37 configure a microstrip line in the region where the second conductive portion 33 is disposed. The power supply point 28 serves as a border point between the radiation electrode 24 and the transmission line 37 having the microstrip line structure.

Figure 5A:
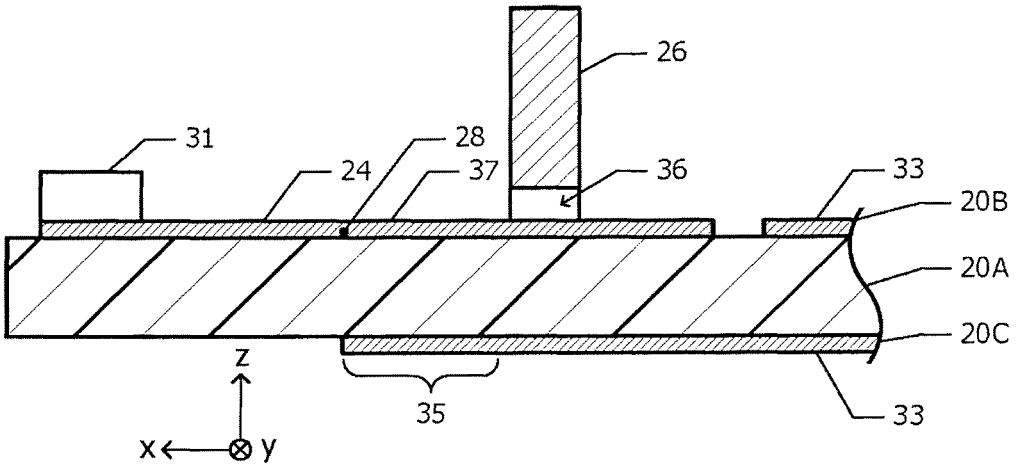
FIGS. 5A and 5B are cross-sectional views taken along dot-dash lines 5A-5A and 5B-5B, respectively, shown in FIG. 3A.
Figure 5B:
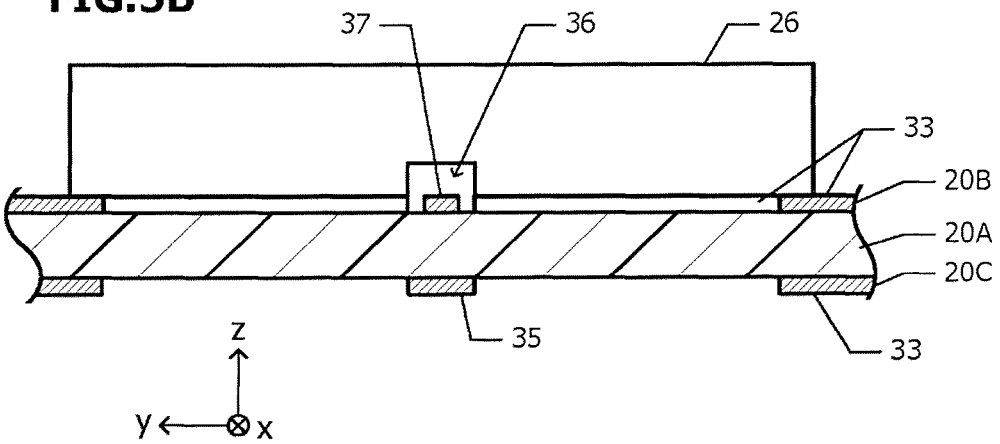

FIGS. 5A and 5B are cross-sectional views taken along dot-dash lines 5A-5A and 5B-5B, respectively, which are indicated in FIG. 3A. The upper conductive layer 20B is disposed on an upper surface of the dielectric plate 20A and the lower conductive layer 20C is disposed on the base surface of the dielectric plate 20A. The radiation electrode 24, the transmission line 37, and the second conductive portion 33 are formed by the upper conductive layer 20B, and the ground layer 35 and the second conductive portion 33 are formed by the lower conductive layer 20C.

A cutout 36 is provided in the reflector plate 26 so that the transmission line 37 and the reflector plate 26 do not make contact with each other at the point of intersection.

Figure 6:
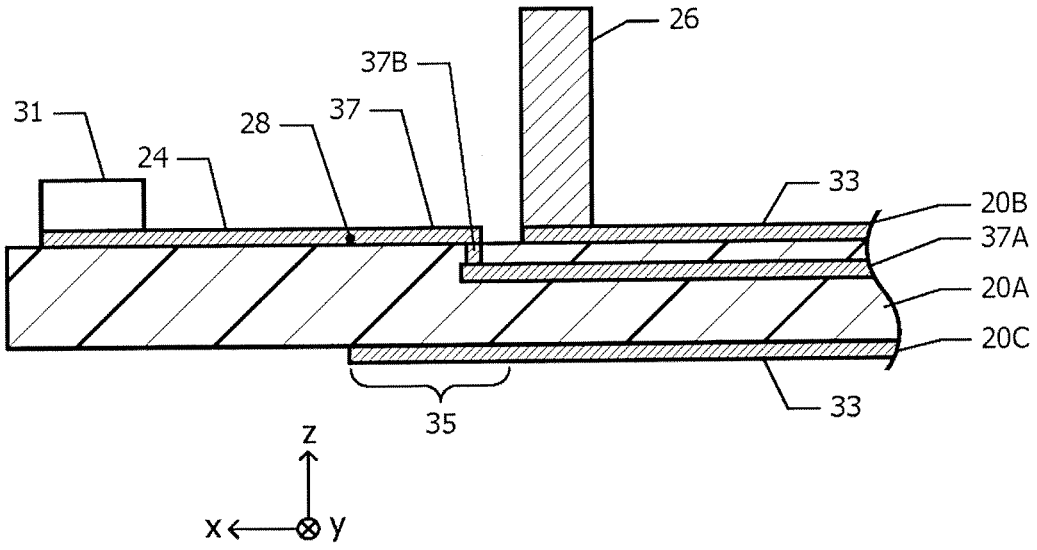
FIG. 6 is a cross-sectional view illustrating an antenna device according to a variation on the second embodiment.

FIG. 6 is a partial cross-sectional view illustrating an antenna device according to a variation on the second embodiment. The cross-sectional view shown in FIG. 6 corresponds to the cross-sectional view shown in FIG. 5A. Hereinafter, differences from the structure illustrated in FIG. 5A will be described.

In the variation shown in FIG. 6, a multilayer wiring board is used as the dielectric plate 20A. A part 37A of the transmission line 37 is embedded in the dielectric plate 20A. The embedded portion 37A is disposed at a point of intersection with the reflector plate 26 and a region that overlaps with the second conductive portion 33. The transmission line 37 formed by the upper conductive layer 20B and an inner layer portion 37A are connected by a conductive via 37B. Because the transmission line 37 is disposed within the dielectric plate 20A at the point of intersection with the reflector plate 26, the transmission line 37 and the reflector plate 26 can be kept insulated from each other. The structure is such that the inner layer portion 37A of the transmission line is interposed between the upper conductive layer 20B and the lower conductive layer 20C in the region where the second conductive portion 33 is disposed.

Although the shape of the reflector plate 26 when viewed from above is substantially rectangular in FIGS. 1A, 5B, and so on, another shape may be employed instead. Meanwhile, the reflector plate 26 need not be perpendicular to the substrate 20. The reflector plate 26 may be disposed at an angle relative to the substrate 20. The reflector plate 26 may be any size that offers a significant improvement in the front-to-back ratio.

Next, effects of the aforementioned first embodiment and second embodiment will be described with reference to FIGS. 7A to 9C. The directivity characteristics were calculated through simulations while varying the dimensions of various elements in the antenna device.

Figure 7A:
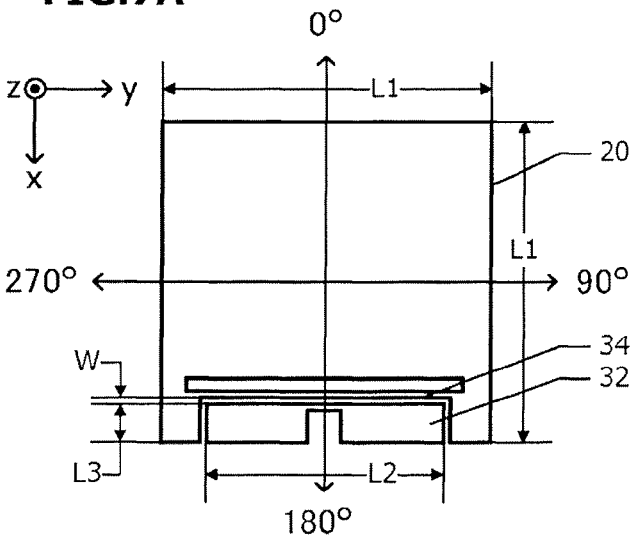
FIG. 7A is a plan view of an antenna device used for a simulation.
Figure 7B:
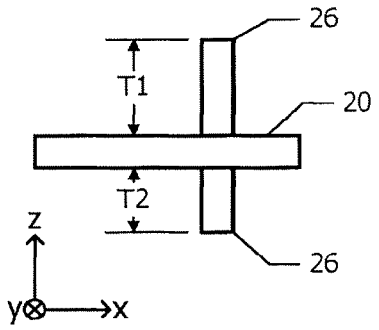
FIG. 7B is a diagram illustrating definitions of dimensions of a conductive layer on both sides of a substrate and a reflector plate.

FIGS. 7A and 7B are a plan view and a partial cross-sectional view, respectively, illustrating an antenna device according to the second embodiment employed in a simulation. The shape of the substrate 20 when seen from above is a square whose length L1 is 70 mm on each side, with a thickness of 1 mm. Dimensions L2 and L3 of the first conductive portion 32 in the y direction and the x direction are 50 mm and 5 mm, respectively. A width W of the isolation band 34 is 2.5 mm. A width of the radiation electrode 24 (FIG. 3A) is 0.5 mm, and a width of the ground layer 35 (FIG. 3B) is 1.1 mm. A height of the upper portion of the reflector plate 26 is represented by T1, and a height of the lower portion of the reflector plate 26 is represented by T2. It is preferable for the dimension L2 of the first conductive portion 32 in the y direction thereof to be set to half the operating wavelength.

Figure 7C:
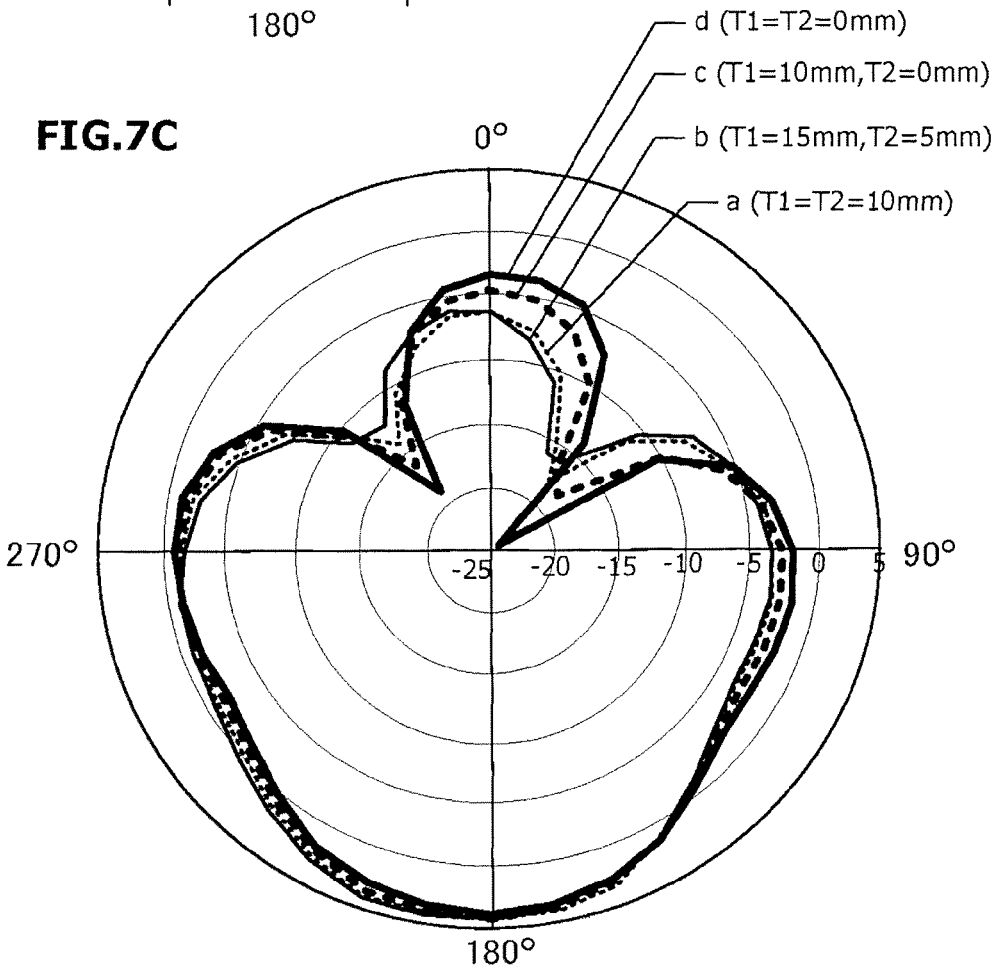
FIG. 7C is a graph illustrating a result of simulating directivity characteristics in an xy plane.

FIG. 7C illustrates a result of the directivity characteristics simulation. A center point corresponds to −25 dBi, and an outermost peripheral line corresponds to 5 dBi. A heading toward the negative side in the x direction (rearward) is taken as 0°, whereas a heading toward the positive side in the y direction is taken as 90°. A heading in the forward direction is thus 180°. In FIG. 7C, a fine broken line a, a fine solid line b, and a bold broken line c indicate simulation results for cases where (T1,T2)=(10 mm,10 mm), (15 mm,5 mm), and (10 mm,0 mm), respectively. A bold solid line d indicates a simulation result for the case where the reflector plate 26 is not provided.

It can be seen that when the reflector plate 26 is provided, radiation in the rearward direction (a heading of) 0° is suppressed, and radiation in the forward direction (a heading of 180°) is strengthened. Specifically, the front-to-back ratios (F/B ratios) were 10.5 dB, 10.0 dB, and 8.6 dB in the case where (T1,T2)=(10 mm,10 mm), (15 mm,5 mm), and (10 mm,0 mm), respectively. As opposed to this, the front-to-back ratio was 6.9 dB in the case where the reflector plate 26 was not provided. Accordingly, the forward directivity can be increased by providing the reflector plate 26.

It was also confirmed that the directivity increases by providing the reflector plate 26 even in the case where the isolation band 34 is not provided, as in the first embodiment illustrated in FIGS. 2A and 2B.

FIGS. 7A to 7C illustrate the directivity characteristics in the xy plane. Next, the directivity characteristics in a zx plane will be described.

Figure 8A:
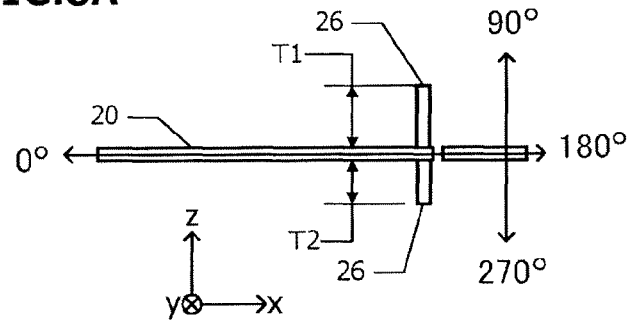
FIG. 8A is a cross-sectional view of an antenna device used for a simulation.
Figure 8B:
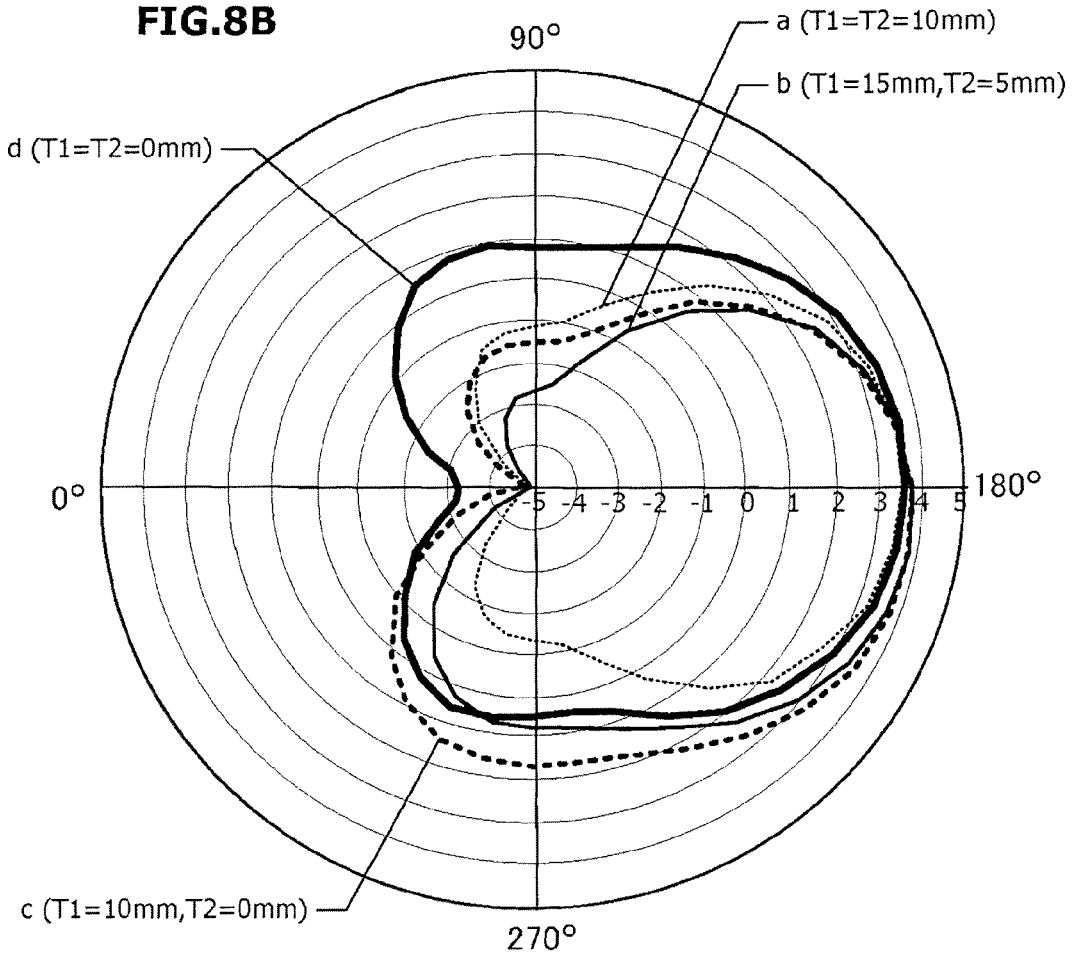
FIG. 8B is a graph illustrating a result of simulating directivity characteristics in a zx plane.

As shown in FIG. 8A, the negative side in the x direction is taken as 0° and the positive side in the z direction is taken as 90°. FIG. 8B illustrates a result of the directivity characteristics simulation. A center point corresponds to −5 dBi, and an outermost peripheral line corresponds to 5 dBi. In FIG. 8B, the fine broken line a, the fine solid line b, and the bold broken line c indicate simulation results for cases where (T1,T2)=(10 mm,10 mm), (15 mm,5 mm), and (10 mm,0 mm), respectively. The bold solid line d indicates a simulation result for the case where the reflector plate 26 is not provided. The radiation strength is maximum in the direction of 180° in the case where the upper and lower portions of the reflector plate 26 have the same height (the fine broken line a) and in the case where the reflector plate 26 is not provided (the bold solid line d). The direction in which the radiation strength is maximum shifts from the direction of 180° to the direction of 270° (the negative direction in the z-axis) in the case where the upper portion of the reflector plate 26 is higher than the lower portion of the reflector plate 26 (the fine solid line b) and the case where only the upper portion of the reflector plate 26 is provided (the bold broken line c).

Accordingly, the direction in which the radiation strength is maximum can be tilted from the positive direction of the x-axis to a vertical direction (the z direction) by varying the height of the upper and lower portions of the reflector plate 26. Furthermore, the angle of tilt can be changed from the positive direction of the x-axis to the direction in which the radiation strength is maximum by adjusting the height of the upper and lower portions of the reflector plate 26.

Figure 9A:
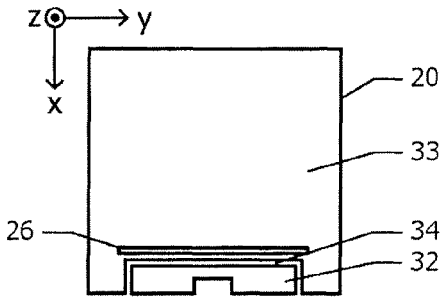
FIGS. 9A and 9B are plan views of antenna devices used for a simulation.

Next, effects of the providing the isolation band 34 (FIG. 3A) will be described with reference to FIGS. 9A to 9C. FIG. 9A is a schematic plan view of the antenna device according to the second embodiment, in which the isolation band 34 is provided, and FIG. 9B is a schematic plan view of the antenna device according to the first embodiment, in which the isolation band is not provided.

Figure 9B:
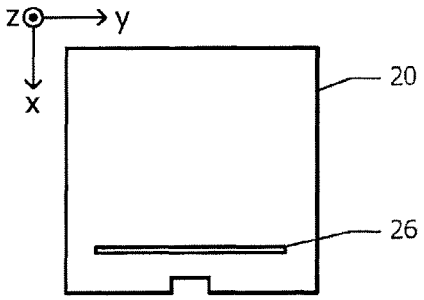
Figure 9C:
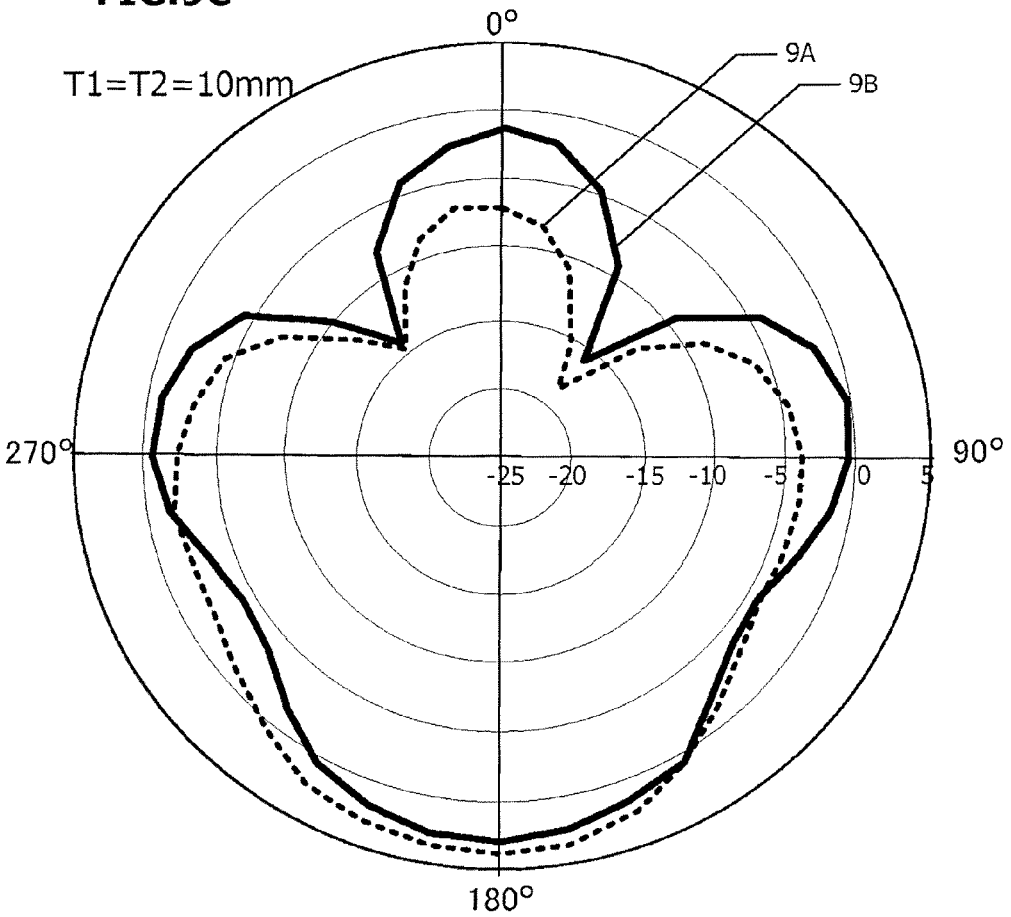
FIG. 9C is a graph illustrating a result of simulating directivity characteristics in an xy plane.

FIG. 9C illustrates a result of the directivity characteristics simulation for the antenna devices illustrated in FIGS. 9A and 9B. A center point corresponds to −25 dBi, and an outermost peripheral line corresponds to 5 dBi. The headings are defined in the same manner as the headings defined in FIG. 7C. A solid line 9A and a broken line 9B indicate the simulation results for the antenna devices shown in FIGS. 9A and 9B, respectively. The height T1 of the upper portion of the reflector plate 26 and the height T2 of the lower portion of the reflector plate 26 are both 10 mm.

It can be seen that when the isolation band 34 is formed, the rearward radiation strength (in the negative direction of the x-axis) drops and the forward radiation strength (in the positive direction of the x-axis) increases. Specifically, while the front-to-back ratio of the antenna device in which the isolation band 34 is formed (FIG. 9A) is 10.5 dB, the front-to-back ratio of the antenna device in which the isolation band is not formed (FIG. 9B) is 4.3 dB. Accordingly, the front-to-back ratio can be increased by providing the isolation band 34.

Furthermore, noise can be suppressed from entering the first conductive portion 32 from the high-frequency circuit 30 (FIG. 3A) by providing the isolation band 34.

Next, an antenna device according to a third embodiment will be described with reference to FIGS. 10A to 12B. Hereinafter, differences from the first embodiment and the second embodiment will be described, whereas descriptions of identical configuration will be omitted.

As illustrated in FIG. 1A and the like, in the first embodiment and the second embodiment, a radiating element including the cutout 23, the radiation electrode 24, the reflector plate 26, and so on is disposed only on one edge of the quadrangular substrate 20. In the third embodiment, a radiating element 40 having the same configuration as the radiating element according to the first embodiment is disposed in each of the four edges. The isolation band 34 (FIG. 3A) is not provided in the antenna device shown in FIG. 10A, whereas the isolation band 34 is provided in each of the plurality of radiating elements 40 in the antenna device shown in FIG. 10B.

Figure 10A:
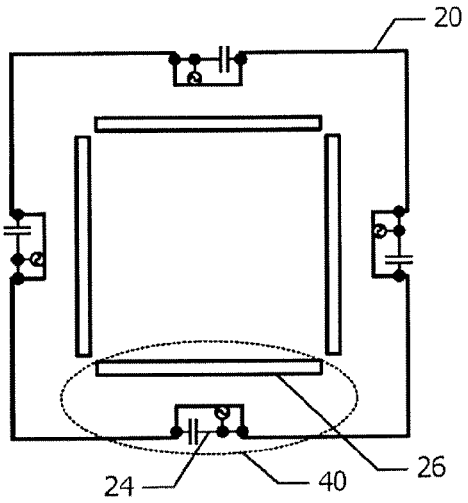
FIGS. 10A and 10B are plan views of antenna devices according to a third embodiment.
Figure 10B:
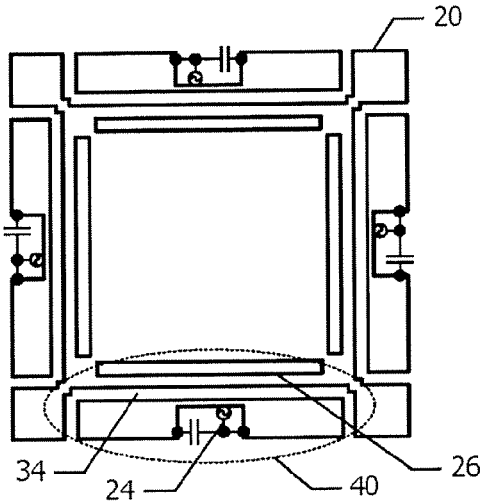
Figure 10C:
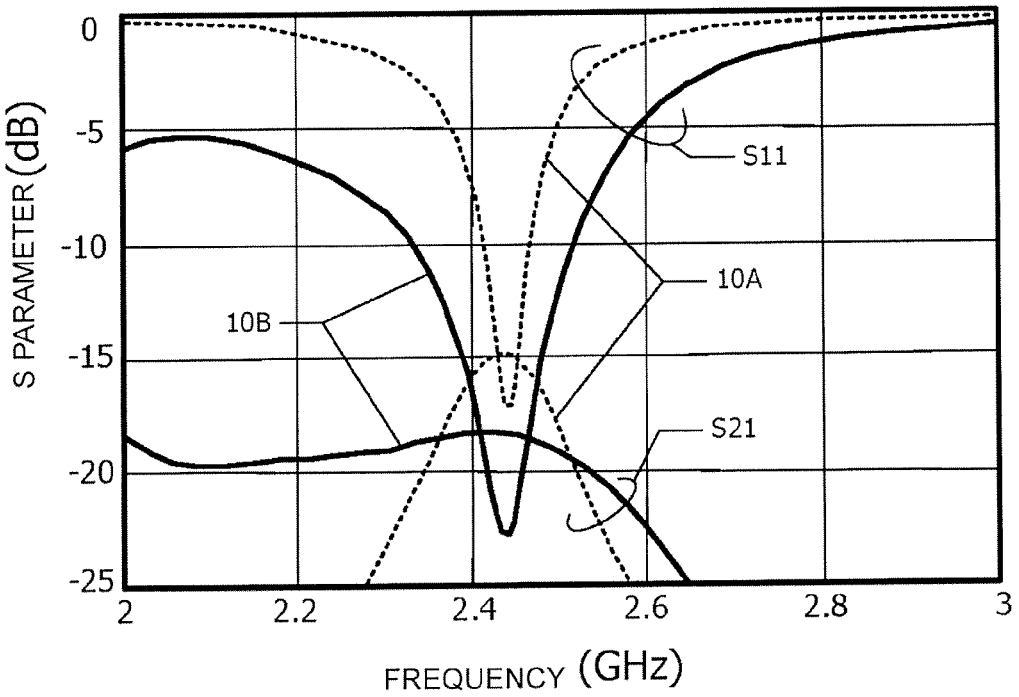
FIG. 10C is a graph illustrating a result of an S parameter simulation.

FIG. 10C illustrates a result of simulating an S parameter of the antenna devices illustrated in FIGS. 10A and 10B. The horizontal axis represents a unit of frequency, namely "GHz", and the vertical axis represents a unit of the S parameter, namely "dB". Broken lines 10A in the drawing indicate S11 and S21 parameters of the antenna device illustrated in FIG. 10A, whereas solid lines 10B indicate S11 and S21 parameters of the antenna device illustrated in FIG. 10B. When power is supplied to one of the radiating elements 40, there is a certain amount of reflection from the radiating elements 40 adjacent thereto. The S21 parameter represents a ratio of the reflected power to the incident power.

Although a maximum value of the S21 parameter in the antenna device shown in FIG. 10A is −15 dB, a maximum value of the S21 parameter in the antenna device shown in FIG. 10B is −18 dB. As can be seen from the simulation results, providing the isolation band 34 in each of the radiating elements 40 makes it possible to increase the isolation between the radiating elements 40. This is because the isolation band 34 makes it difficult for a current distribution in one of the radiating elements 40 to affect a current distribution in the radiating elements 40 adjacent thereto.

Although the shape of the substrate 20 when viewed from above is indicated as being quadrangular in FIGS. 10A and 10B, a polygonal shape aside from a quadrangle may be used instead. For example, a polygon such as a triangle, a pentagon, or the like may be used.

Figure 11A:
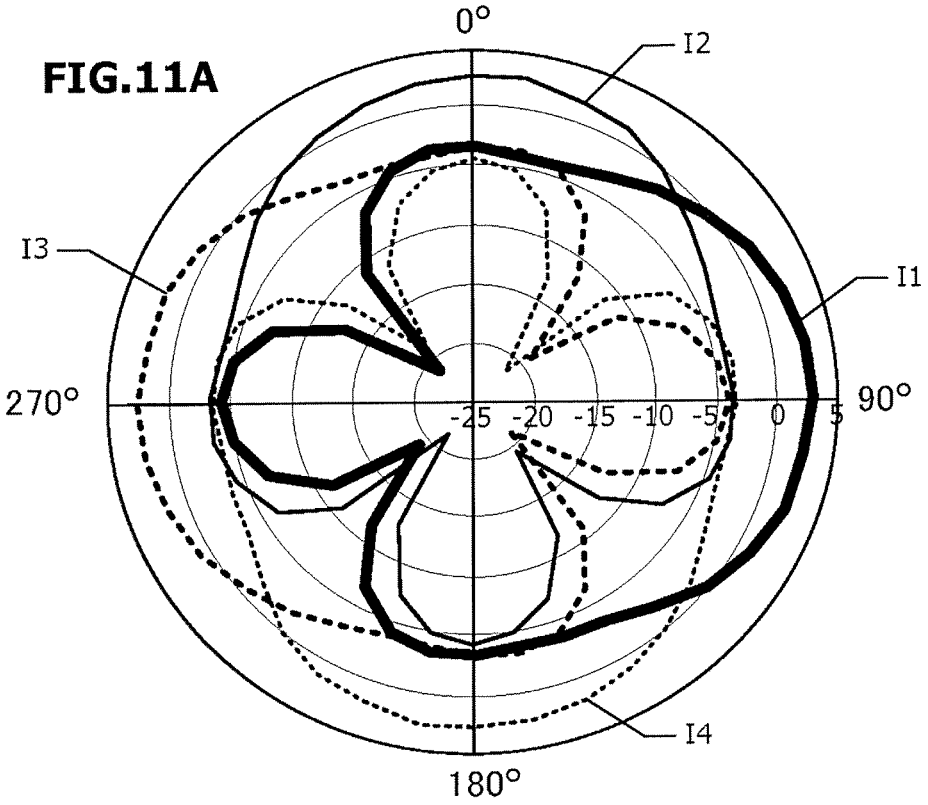
FIGS. 11A and 11B are graphs illustrating a result of simulating directivity characteristics of the antenna devices shown in FIGS. 10A and 10B, respectively.
Figure 11B:
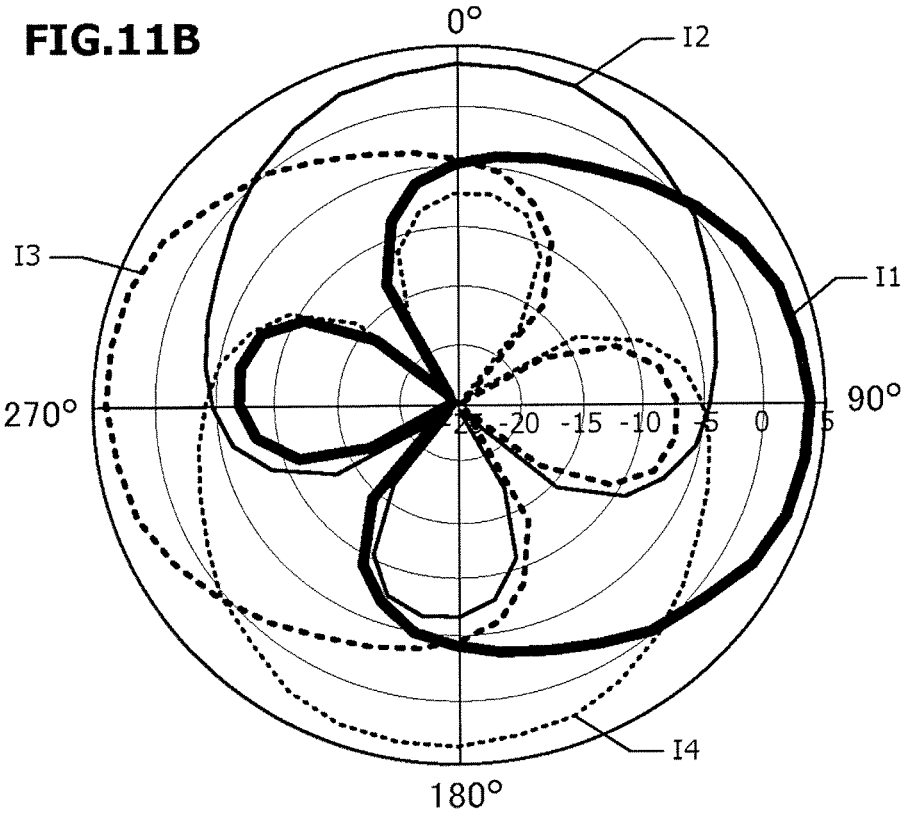

FIGS. 11A and 11B illustrate results of the directivity characteristics simulations for the antenna devices illustrated in FIGS. 10A and 10B, respectively. A center point corresponds to −25 dBi, and an outermost peripheral line corresponds to 5 dBi. A bold solid line I1, a fine solid line I2, a bold broken line I3, and a fine broken line I4 shown in FIGS. 11A and 11B indicate radiation characteristics of the radiating elements 40 facing in headings of 90°, 0°, 270°, and 180°, respectively. In both of the antenna devices shown in FIGS. 10A and 10B, the directions in which the radiation strength is high are four different directions.

Focusing on a single radiating element 40, the front-to-back ratio of the radiating elements 40 shown in FIGS. 10A and 10B are 7 dB and 12 dB, respectively. Increasing the front-to-back ratios of each of the radiating elements 40 makes it possible to find the field strengths in the four directions in an isolated manner.

Next, a working example of the antenna device according to the third embodiment will be described with reference to FIGS. 12A and 12B.

Figure 12A:
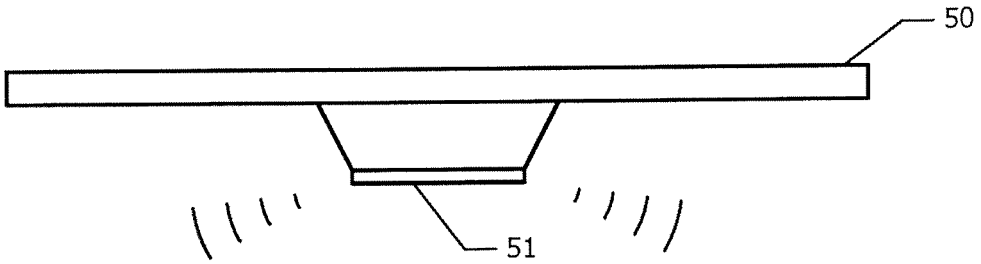
FIGS. 12A and 12B are a front view and a plan view, respectively, illustrating a working example of the antenna device according to the third embodiment.

As shown in FIG. 12A, an antenna device 51 according to the third embodiment is attached to a ceiling 50 of an architectural structure. The substrate 20 of the antenna device 51 (FIGS. 10A and 10B) is substantially horizontal. With respect to the vertical direction, the heights of the upper and lower portions of the reflector plate 26 (FIG. 8A) are adjusted so that the direction in which the radiation strength is greatest is downward relative to the horizontal direction.

Figure 12B:
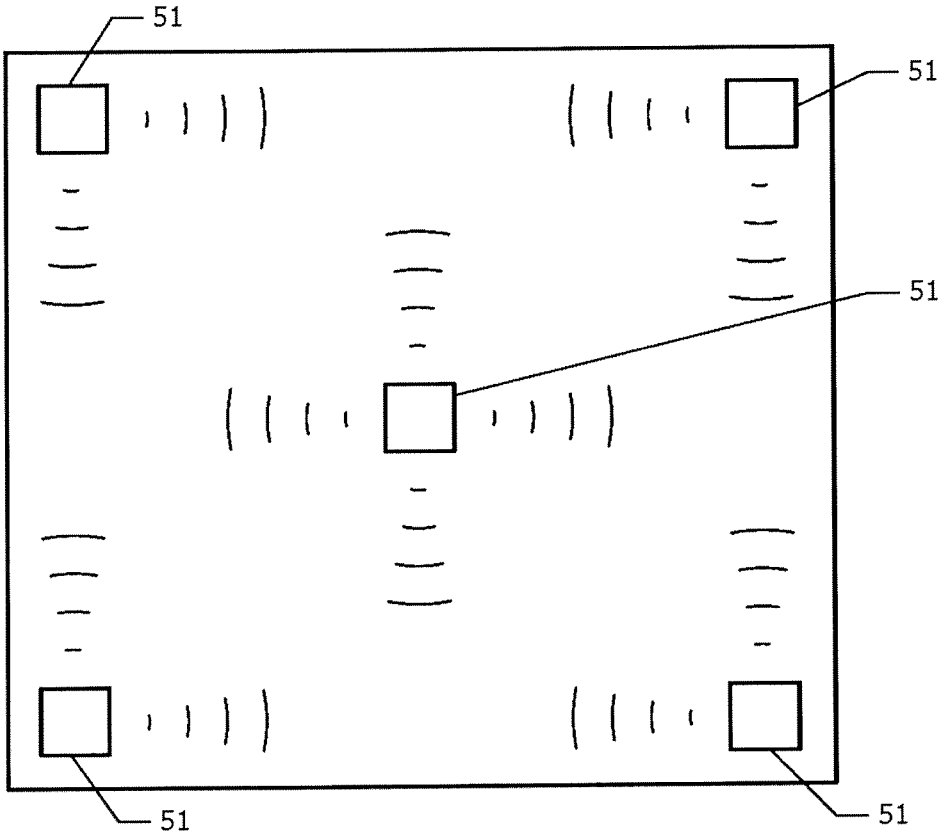

FIG. 12B illustrates a planar arrangement of the antenna devices 51. A plurality of the antenna devices 51 are attached to a ceiling. The radiating elements 40 (FIGS. 10A and 10B) of each antenna device 51 measure the field strength. The location of the emission source of a signal can be narrowed down based on the field strengths received by the radiating elements 40. By having a person traversing the floor carry an oscillator, the location of the person can be narrowed down.

With respect to the vertical direction, setting the direction in which the radiation strength is greatest to be downward relative to the horizontal direction makes it possible to efficiently receive a signal from the oscillator carried by the person traversing the floor.

Next, various examples of the configurations of the short point 25, the power supply point 28, and the radiation electrode 24 will be given with reference to FIGS. 13A to 13D.

Figure 13A:
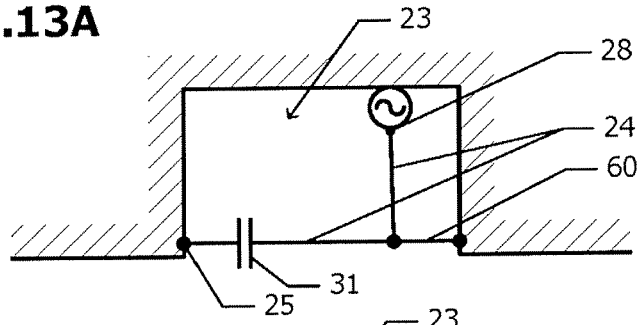
FIGS. 13A to 13D are equivalent circuit diagrams illustrating examples of the configuration of a radiating element portion.
Figure 13B:
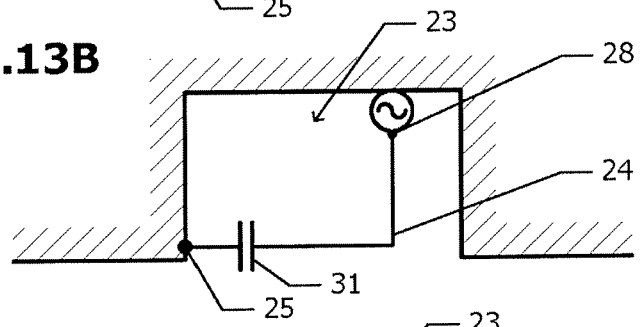

A power supply circuit shown in FIG. 13A is equivalent to a power supply circuit used in the antenna device according to the first embodiment illustrated in FIG. 2A. The power supply point 28 is positioned in a leading end area of the cutout 23. The radiation electrode 24 that extends from the power supply point 28 is connected to the short point 25. The capacitive reactance element 31 is inserted into the radiation electrode 24. Furthermore, the radiation electrode 24 is shorted to an edge of the cutout 23 via a matching short portion 60 (FIG. 13A), on the opposite side as the short point 25. The configuration may omit the matching short portion 60, as shown in FIG. 13B.

Figure 13C:
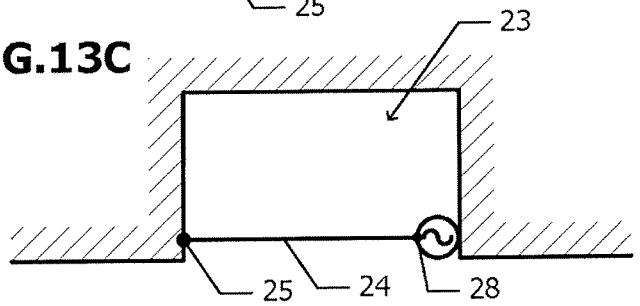
Figure 13D:
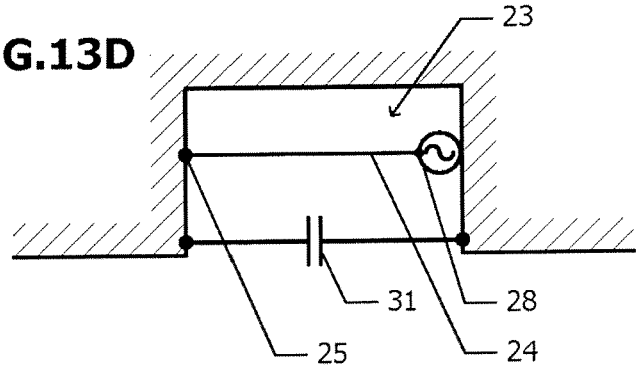

As shown in FIG. 13C, the power supply point 28 may be disposed on one edge of the cutout 23, and the short point 25 may be provided on the opposite edge of the cutout 23. The radiation electrode 24 extends from the power supply point 28 to the short point 25. The short point 25 and the power supply point 28 are located near an open end area of the cutout 23. As shown in FIG. 13D, the locations of the short point 25 and the power supply point 28 may be shifted further inward than the open end area of the cutout 23. In this case, the capacitive reactance element 31 may be inserted between the edges on both sides of the open end area.

Although the present invention has been described thus far with reference to embodiments, the present invention is not intended to be limited to those embodiments. That many changes, improvements, combinations, and so on can be made will be clear to persons skilled in the art.

REFERENCE SIGNS LIST

20 substrate
20A dielectric plate
20B upper conductive layer
20C lower conductive layer
20D through via
21 edge
23 cutout
24 radiation electrode
25 ground point (short point)
26 reflector plate
27 fastener
28 power supply point

29 capacitive reactance element
30 high-frequency circuit element
31 transmission line (microstrip line)
37A inner layer transmission line
37B conductive via
32 first conductive portion
33 second conductive portion
34 isolation band (gap)
35 ground layer
36 cutout
40 radiating element
50 ceiling
51 antenna device
60 matching short portion

The invention claimed is:

1. An antenna device comprising:
a substrate including a dielectric plate and conductive layers disposed on opposing surfaces of the dielectric plate;
a first cutout in the conductive layers on the opposing surfaces of the dielectric plate substrate, the first cutout extending inward from a first edge of the substrate;
a first radiation electrode electrically connected to the conductive layers at a first connection point disposed in the first cutout; and
a first conductive reflector plate disposed on the substrate and facing the first connection point, the first conductive reflector plate being electrically connected to the conductive layer.

2. The antenna device according to claim 1, wherein the first connection point is disposed on an outer peripheral line of the first cutout.

3. The antenna device according to claim 1, wherein the first conductive reflector plate is disposed at an inward position on the substrate relative to the first cutout.

4. The antenna device according to claim 1, wherein the conductive layers includes:
a first conductive portion that extends from the first cutout; and
a second conductive portion that is disposed at an inward position on the substrate relative to the first conductive portion, with a gap disposed between the first conductive portion and the second conductive portion.

5. The antenna device according to claim 4, wherein the first conductive portion extends from the first cutout along the first edge of the substrate in opposite directions.

6. The antenna device according to claim 4, wherein the first reflector plate is electrically shorted to the second conductive portion.

7. The antenna device according to claim 1, wherein the first reflector plate is attached to the substrate extending in a direction perpendicular to the substrate.

8. The antenna device according to claim 1, further comprising:
a high-frequency circuit; and
a first transmission line that electrically connects the first radiation electrode to the high-frequency circuit.

9. The antenna device according to claim 8, wherein the high-frequency circuit is disposed at an inward position on the substrate relative to the first reflector plate.

10. The antenna device according to claim 8, wherein the first transmission line intersects with an imaginary plane on which the first reflector plate is disposed and is electrically insulated from the first reflector plate.

11. The antenna device according to claim 10, wherein the first transmission line is embedded in the dielectric plate.

12. The antenna device according to claim 1, wherein the first reflector plate is disposed on both surfaces of the substrate.

13. The antenna device according to claim 12, wherein the first reflector plate has different heights on each side of the substrate.

14. The antenna device according to claim 1, wherein the substrate comprises a polygonal shape and the first edge corresponds to one side of the polygonal shape.

15. An antenna device comprising:
a substrate including a dielectric plate and conductive layers disposed on opposing surfaces of the dielectric plate;
a first cutout in the conductive layers on the opposing surfaces of the dielectric plate substrate, the first cutout extending inward from a first edge of the substrate;
a first radiation electrode electrically connected to the conductive layers at a first connection point disposed in the first cutout;
a first conductive reflector plate disposed on the substrate and facing the first connection point, the first conductive reflector plate being electrically connected to the conductive layer;
a second cutout in the conductive layers that extends inward from at least one second edge of the substrate;
a second radiation electrode electrically connected to the conductive layers at a second connection point disposed in the second cutout; and
a second reflector plate disposed on the substrate and facing the second connection point, the second reflector plate electrically connected to the conductive layer.

16. The antenna device according to claim 15, wherein the first and second connection points are disposed on outer peripheral lines of the first and second cutouts, respectively.

17. The antenna device according to claim 15, wherein the first conductive reflector plate is disposed at an inward position on the substrate relative to the first cutout and the second conductive reflector plate is disposed at an inward position on the substrate relative to the second cutout.

18. The antenna device according to claim 15, wherein the conductive layers include:
first conductive portions that extends from the first and second cutout, respectively,
a second conductive portion that is disposed at an inward position on the substrate relative to the first conductive portions, with a gap disposed between the first conductive portions and the second conductive portion.

19. The antenna device according to claim 18, wherein the first conductive portions extend from the first and second cutouts, respectively, along the respective first and second edges of the substrate in opposite directions.

20. The antenna device according to claim 18, wherein the first and second reflector plates are electrically shorted to the second conductive portion.

* * * * *